US008508131B2

(12) United States Patent
Kim

(10) Patent No.: US 8,508,131 B2
(45) Date of Patent: Aug. 13, 2013

(54) ELECTRODELESS LIGHTING SYSTEM

(75) Inventor: Jeongwon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 335 days.

(21) Appl. No.: 12/833,221

(22) Filed: Jul. 9, 2010

(65) Prior Publication Data

US 2011/0006682 A1 Jan. 13, 2011

(30) Foreign Application Priority Data

Jul. 10, 2009 (KR) ..... 10-2009-0063182

(51) Int. Cl.
*H01J 7/46* (2006.01)

(52) U.S. Cl.
USPC ..... 315/39; 315/39.55; 315/248

(58) Field of Classification Search
USPC ..... 315/39, 51, 149, 106, 307, 150, 160, 315/151, 156–158
See application file for complete search history.

(56) References Cited

U.S. PATENT DOCUMENTS 4,673,846 A * 6/1987 Yoshizawa et al. ..... 315/248
4,975,625 A * 12/1990 Lynch et al. ..... 315/344
5,786,667 A * 7/1998 Simpson et al. ..... 315/39
5,834,895 A * 11/1998 Dolan et al. ..... 313/570
5,847,517 A * 12/1998 Ury et al. ..... 315/248
6,661,183 B2 * 12/2003 Park et al. ..... 315/248
6,850,010 B1 * 2/2005 Barry et al. ..... 315/39.51
7,081,707 B2 * 7/2006 Lee et al. ..... 315/39

FOREIGN PATENT DOCUMENTS

| | | | |
|---|---|---|---|
| JP | 1 084503 | A | 3/1989 |
| JP | 06-104082 | B | 4/1994 |
| JP | 09-320543 | A | 12/1997 |
| JP | 2006-258779 | A | 9/2006 |
| KR | 10-2001050569 | A | 6/2001 |
| KR | 10-2008071424 | A | 8/2008 |

OTHER PUBLICATIONS

European Search Report dated Feb. 8, 2011 for Application No. 10168754.9, 7 pages.

* cited by examiner

*Primary Examiner* — Douglas W Owens
*Assistant Examiner* — Amy Yang
(74) *Attorney, Agent, or Firm* — Fish & Richardson P.C.

(57) ABSTRACT

An electrodeless lighting system is disclosed. A rectangular wave guide is bent substantially at a right angle, and a magnetron and a resonator are disposed at one side based on a wave guide space of the wave guide, thus reducing the space between the magnetron and the resonator and removing an unnecessary space within a casing to reduce the size of the electrodeless lighting system. Accordingly, the amount of space required for installation of the electrodeless lighting system can be reduced and the installation process can be simplified.

8 Claims, 3 Drawing Sheets

ELECTRODELESS LIGHTING SYSTEM

The present application claims priority to Korean Application No. 10-2009-0063182 filed in Korea on Jul. 10, 2009, the entire contents of which is hereby incorporated by reference in its entirety.

BACKGROUND OF THE INVENTION

1. Field of the Invention

The present invention relates to an electrodeless lighting system and, more particularly, to an electrodeless lighting system in which a magnetron and a resonator are disposed to close to each other by bending a middle portion of a wave guide.

2. Description of the Related Art

In general, an electrodeless lighting system emits light by making a light emission material encapsulated in an electrodeless bulb electrodeless by using microwave energy generated from a microwave generating unit such as a magnetron. The electrodeless lighting system is an electrodeless bulb without an electrode or filament therein, which has a very long life span or is semi-permanent and emits light as good as natural light.

The electrodeless lighting system generally includes a magnetron generating microwaves, an electrodeless bulb charged with a luminous material to generate light by using the microwaves transferred from the magnetron, a resonator accommodating the electrodeless bulb and resonating the microwaves transferred from the magnetron, and a wave guide connecting the magnetron and the resonator to allow microwaves generated by the magnetron to be delivered to the resonator.

The electrodeless lighting system configured as described above operates as follows.

Namely, microwaves generated by the magnetron are transferred to the resonator through the wave guide, and the microwaves introduced into the resonator are resonated within the resonator to excite the luminous material of the electrodeless bulb. Then, the luminous material charged in the electrodeless bulb is converted into an electrodeless state, generating light, and the light is irradiated to a front side by a reflection shade installed at a rear side of the electrodeless bulb.

However, in the related art electrodeless lighting system, the wave guide is formed to have a rectangular shape and the resonator is installed at one side of the wave guide in a heightwise direction. The magnetron is installed at the other side of the wave guide and the resonator in a lengthwise direction at a certain interval therebetween. That is, the resonator and the magnetron are positioned at both upper and lower sides of the wave guide, increasing the size of the lighting system overall. Thus, a large space is required to install the electrodeless lighting system and, because the electrodeless lighting system is large in size, it is difficult to install the electrodeless lighting system.

SUMMARY OF THE INVENTION

Therefore, in order to address the above matters, the various features described herein have been conceived.

An aspect of the present invention provides an electrodeless illumination device (such as an electrodeless lighting system) having a minimal size, such that the amount of space required for installation can be reduced and the installation process can be simplified.

According to an aspect of the present invention, there is provided an electrodeless lighting system including: a magnetron; a wave guide having a wave guide space to communicate with the magnetron; a resonator coupled to communicate with the wave guide space of the wave guide; and an electrodeless bulb disposed within a resonating space of the resonator, wherein the wave guide includes a first wave guide part to which the magnetron is coupled and a second wave guide part to which the resonator is coupled, and a wave guide space of the first wave guide part and a wave guide space of the second wave guide part are bent to communicate with each other.

According to another aspect of the present invention, there is provided an electrodeless lighting system including: a magnetron; a wave guide to which the magnetron is coupled; a resonator coupled to the waveguide; and an electrodeless bulb disposed within the resonator, wherein the wave guide includes a first wave guide part to which the magnetron is coupled, a second wave guide part to which the resonator is coupled, and a direction changing part provided between the first and second wave guide parts and changing the direction of microwave, which proceeds through the first wave guide part, to transfer the microwave to the second wave guide part.

According to another aspect of the present invention, there is provided an electrodeless lighting system including: a magnetron having an antenna unit for radiating microwave; a resonator having a resonating space for resonating microwave radiated through the antenna unit of the magnetron; and a light guide having a light guide space to guide microwave radiated through the antenna unit of the magnetron to the resonating space, wherein the light guide includes a first face having an introduction hole allowing the antenna unit to be inserted therethrough and a second face having a draw slit communicating with the resonating space of the resonator, and the first and second faces present at different planes.

The foregoing and other objects, features, aspects and advantages of the present invention will become more apparent from the following detailed description of the present invention when taken in conjunction with the accompanying drawings.

DETAILED DESCRIPTION OF THE INVENTION

A wave guide and an electrodeless lighting system having the same according to exemplary embodiments of the present invention will now be described in detail with reference to the accompanying drawings.

Figure 1:
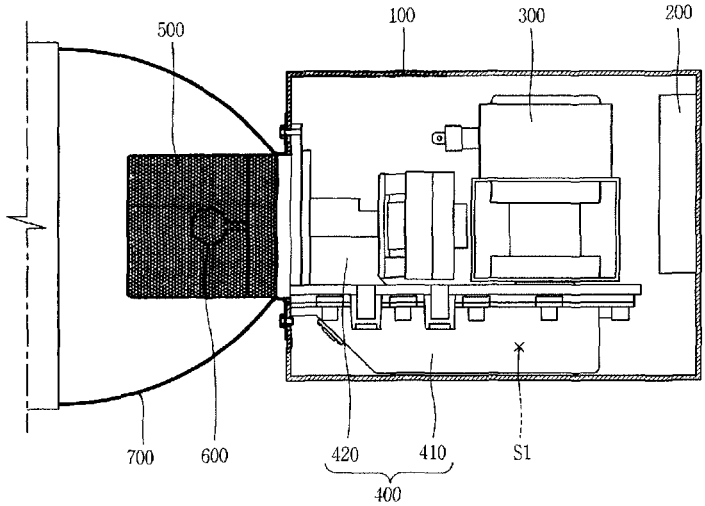
FIG. 1 is a side view showing the interior of a casing of an electrodeless lighting system according to an exemplary embodiment of the present invention.
Figure 2:
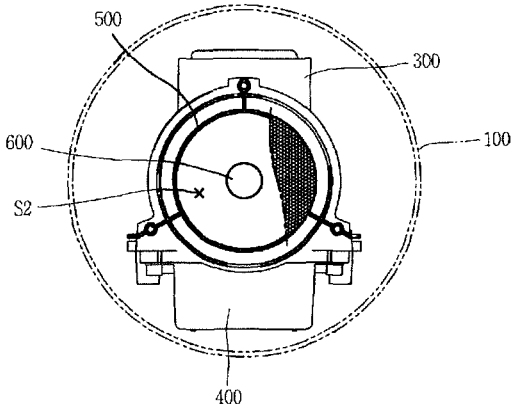
FIG. 2 is a front view of the electrodeless lighting system of FIG. 1.

FIG. 1 is a side view showing the interior of a casing of an electrodeless lighting system according to an exemplary embodiment of the present invention, and FIG. 2 is a front view of the electrodeless lighting system of FIG. 1.

As shown in FIGS. 1 and 2, the electrodeless lighting system having a resonator according to an exemplary embodiment of the present invention includes a high voltage generator 200 for generating a high voltage is installed in an inner space of a casing 100, and a magnetron 300 for generating microwave upon receiving the high voltage from the high voltage generator 200 is installed at one side of the high voltage generator 200. A wave guide 400 for guiding the microwave oscillated from the magnetron 300 is coupled to one side of the magnetron 300.

A resonator 500 forming a resonance mode by shielding an external discharge of microwave is coupled to an outlet side of the wave guide 400 at an outer side of the casing 100, and an electrode bulb 600 including a luminous material to emit light upon being excited by microwave is installed in the interior of the resonator 500. A reflection shade 700 is installed at an outer side of the casing 100 and accommodates the resonator 500 therein to concentrate light emitted from the electrodeless bulb 600 forward.

The wave guide 400 includes a first wave guide part 410 to which the magnetron 300 is coupled and a second wave guide part 420 bent from the first wave guide part 410.

Figure 3:
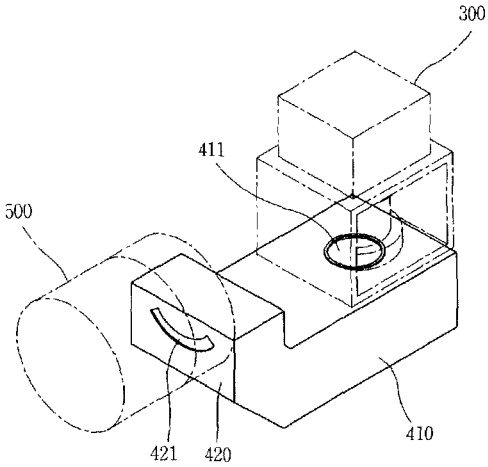
FIG. 3 is a schematic perspective view of a wave guide of FIG. 1.
Figure 4:
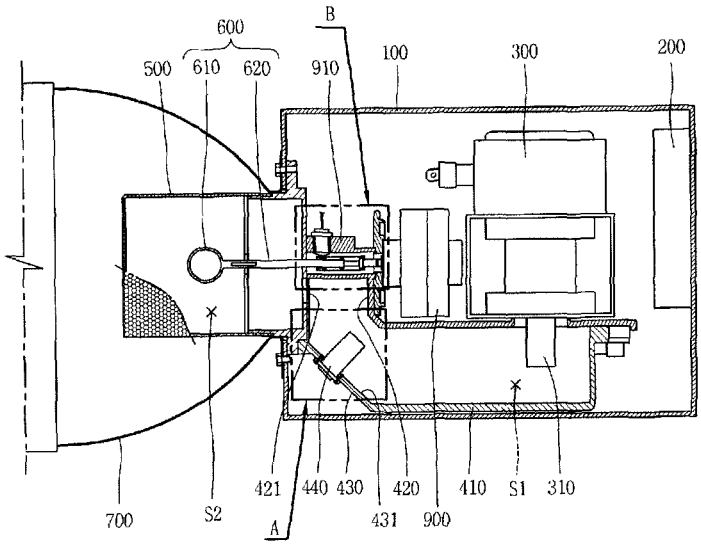
FIG. 4 is a side sectional view showing the wave guide and a resonator of the electrodeless lighting system of FIG. 1.

As shown in FIGS. 3 and 4, a wave guide space S1 is formed to communicate from the first wave guide 410 to the second wave guide 420 and has a substantially same sectional area. One side of the first wave guide 410 includes an introduction hole 411 allowing an antenna unit 310 to be inserted therethrough, and one side, namely, an outer side, of the second wave guide 420 includes a draw slit 421 allowing a resonance space S2 of the resonator 500 and the wave guide space S1 to communicate with each other.

Here, the magnetron 300 is coupled in a direction in which a lengthwise direction of the antenna unit 310 is perpendicular to a lengthwise direction of the first wave guide 410, and the resonator 400 is coupled in a direction in which an axial center of the resonator 400 is perpendicular to a lengthwise direction of the second wave guide 420. Thus, the installation direction of the magnetron 300 and that of the resonator 500 are substantially perpendicular. Namely, a first face to which the magnetron 300 is coupled and a second face to which the resonator is coupled are bent at a right angle. The first face includes the introduction hole 411 and the second face includes the draw slit 421.

Figure 5:
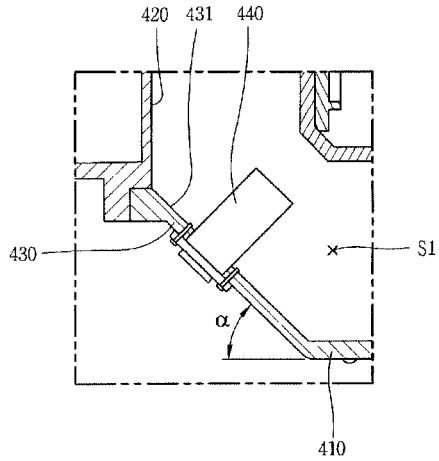
FIG. 5 is an enlarged view of a portion 'A' in FIG. 4.
Figure 6:
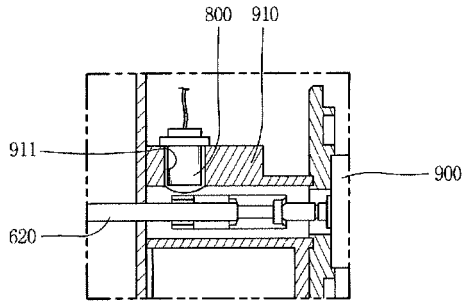
FIG. 6 is an enlarged view of a portion 'B' in FIG. 4.

As shown in FIG. 5, a direction changing part 430 is formed between the first and second wave guide parts 410 and 420 in order to changing a proceeding direction of the microwave oscillated from the magnetron 300.

The direction changing part 430 may be formed as a slope face 431 in order to minimize a reflection of the microwave proceeding from the first wave guide part 410 to the second wave guide part 420 from the direction changing part 430. A slope angle ($\alpha$) of the slope face 431 substantially ranges from 40 degrees to 50 degrees. Preferably, the slope face 431 may have a slope angle of 45 degrees in order to minimize the reflectance of the microwave.

The length of the second wave guide part 420 may vary depending on the size of the frequency of microwave. When the frequency of microwave is 2485 kz, the second wave guide part 420 may have the length of $\lambda g/4$, namely, ranging from 40 mm to 45 mm, in order to minimize the reflectance of microwave.

As shown in FIGS. 4 and 5, one or more impedance matching members (i.e., stubs) 440 may be insertedly installed with a certain height at a central portion of the slope face 431 within the wave guide space in order to make an optimum impedance matching according to a load variation.

The stub 440 may be may be configured as a solid bar or a hollow bar made of a metal material such as copper or aluminum. The stub 440 may be fastened with a screw so that its insertion depth can be varied. Preferably, the standard or an insertion depth of the stub 440 is automatically determined when a load and a source (oscillation frequency, RS power) of the lighting system are matched, so the stub 440 may be fixedly coupled to the slope face 431 of the wave guide 400. In this case, the standard of the stub 440 may have a diameter ranging from 10 mm to 12 mm, and the insertion depth of the stub 440 may range from 20 mm to 25 mm.

A photo sensor 800 may be installed between the magnetron 300 and the resonator 500. The photo sensor 800 detects whether or not the electrodeless bulb 600 is emitting the light, for determining whether or not to operate the magnetron 300. The photo sensor 800 may be electrically connected to a control unit (not shown) that controls the operation of the magnetron 300.

The photo sensor 800 may be installed near an axial part 620 integrally connected to the light emission unit 610 of the electrodeless bulb 610 in order to facilitate an installation operation of the photo sensor 800. To this end, a bulb motor 900 is installed between the magnetron 300 and the resonator 500 and coupled to the axial part 620 of the electrodeless bulb 600 to rotate the electrodeless bulb 600. A sensor hole 811 is formed to allow the photo sensor 800 to be installed at a motor bracket 910 supporting the bulb motor 900 at the casing 100.

The sensor hole 911 may be formed at a position at which light can be easily detected. For example, the sensor hole 911 may be formed at a position on the axial part 620. The sensor hole 911 may be formed to have a proper size in consideration of a leakage of electromagnetic wave.

The electrodeless lighting system constructed as described above operates as follows.

When a driving signal is inputted to the high voltage generator 200, the high voltage generator 200 boosts (or increases) AC power and supplies the boosted high voltage to the magnetron 300. Then, the magnetron 300, oscillated by the high voltage, generates microwave having a very high frequency.

The microwave is discharged to an outer side of the magnetron 300 through the antenna unit 310 of the magnetron 300, and the discharged microwave is guided to the wave guide space S1 of the wave guide 400.

The microwave, which has been guided to the wave guide space S1 of the wave guide 400, is delivered from the first wave guide part 410 to the second wave guide part 420, and guided into the interior of the resonator 500 through the draw slit 421 of the second wave guide part 420 so as to be radiated. A resonance mode is formed in the interior of the resonator 500 by the radiated microwave.

Then, an electric discharge material charged in the electrodeless bulb 600 in the resonance mode formed in the interior of the resonator 500 is excited to be continuously turned plasma to emit light having a unique emission spectrum, and the light is reflected forward by the reflection shade 700, brightening the space.

Here, as for the magnetron 300 and the resonator 500, the magnetron 300 and the resonator 500 are installed at one side of the wave guide 400, including the first wave guide part 410 and the second wave guide part 420 bent from the first wave guide part 410, based on the lengthwise direction of the wave guide space S1.

Thus, the magnetron 300 and the resonator 500 are disposed to be close, reducing an unnecessary space therebetween. As a result, the size of the electrodeless lighting system can be reduced, and accordingly, the space for installation of the electrodeless lighting system can be reduced. Also, the installation process of the electrodeless lighting system can be simplified.

Also, because the second wave guide part 420 is bent from the first wave guide part 410, microwave oscillated from the magnetron 300 may be possibly reflected from the direction changing part 430 corresponding to the bent portion between the first wave guide part 410 and the second wave guide part 420 so as to be returned to the magnetron 300.

In this case, however, because the slope face 431 is formed on the direction changing part 430 between the first wave guide part 410 and the second wave guide part 420, the microwave delivered from the first wave guide part 410 cannot be reflected toward the magnetron 300 but can be smoothly moved toward the second wave guide part 420 by virtue of the slope face 431. Thus, degradation of a life span of the electrodeless lighting system can be prevented and a luminous efficiency can be improved.

Also, because the installation of the stub 440 on the slope face 431 can actively cope with a change in impedance according to a load variation from a high output to a low output, various standards of electrodeless lighting systems can be provided.

In addition, the photo sensor 800 is installed near the axial part 620 of the electrodeless bulb 600 to detect light transferred through the axial part 620 to determine whether or not electric discharging has occurred. Namely, when no light is detected by the photo sensor 800, the control unit determines that electric discharging has not occur and promptly stops the magnetron 300, to thereby prevent the microwave from flowing backward to the magnetron 300 to damage the magnetron.

The electrodeless lighting system according to an exemplary embodiment of the present invention can be applicable to a high output lighting system of 1 kW class or higher using microwave or to a medium or low output lighting system of handreds of watt class.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electrodeless lighting system comprising:

a magnetron;

a wave guide having a wave guide space to communicate with the magnetron;

a resonator coupled to the wave guide to communicate with the wave guide space of the wave guide;

an electrodeless bulb disposed within a resonating space of the resonator; and a bulb motor installed between the magnetron and the resonator, the bulb motor being configured to rotate the electrodeless bulb, wherein the wave guide includes a first wave guide part to which the magnetron is coupled and a second wave guide part to which the resonator is coupled, and a wave guide space of the first wave guide part and a wave guide space of the second wave guide part are bent to communicate with each other, wherein the second wave guide part is bent in a direction in which the magnetron is coupled to the first wave guide part, and wherein the magnetron is communicatively coupled to the first wave guide space in a direction perpendicular to a direction in which the resonator is communicatively coupled to the second wave guide space.

2. The lighting system of claim 1, wherein the first and second wave guide parts are bent at a right angle, and a slope face sloping at 40 degrees to 50 degrees is formed at the bent portion between the first and second wave guide parts.

3. The lighting system of claim 2, wherein one or more impedance matching members are installed at the slope face.

4. The lighting system of claim 1, wherein a photo sensor is installed between the magnetron and the resonator, the photo sensor configured to detect whether or not discharging occurs depending on whether or not the electrodeless bulb emits light.

5. The lighting system of claim 4, wherein the photo sensor is electrically connected to a control unit for controlling the operation of the magnetron.

6. The lighting system of claim 4, wherein the electrodeless bulb comprises a light emission unit in which an electric discharge material is encapsulated and an axial part extending from the light emission unit, and the photo sensor is installed near the axial part of the electrodeless bulb to detect light transferred through the axial part.

7. The lighting system of claim 6, wherein the bulb motor is coupled to an end portion of the axial part and is supported by a motor bracket so as to be fixed to a casing

8. The lighting system of claim 7, wherein the motor bracket comprises a sensor hole for installing the photo sensor.

* * * * *